US006661923B1

(12) United States Patent
Koike et al.

(10) Patent No.: US 6,661,923 B1
(45) Date of Patent: Dec. 9, 2003

(54) CODING DEVICE, CODING METHOD, DECODING DEVICE, DECODING METHOD, PROGRAM RECORDING MEDIUM AND DATA RECORDING MEDIUM

(75) Inventors: Takashi Koike, Kanagawa (JP); Kenichi Imai, Tokyo (JP); Minoru Tsuji, Chiba (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/403,719

(22) PCT Filed: Feb. 26, 1999

(86) PCT No.: PCT/JP99/00955

§ 371 (c)(1),
(2), (4) Date: Nov. 19, 1999

(87) PCT Pub. No.: WO99/44291

PCT Pub. Date: Sep. 2, 1999

(30) Foreign Application Priority Data

Feb. 26, 1998 (JP) ..... 10-045900

(51) Int. Cl.[7] ..... G06K 9/36
(52) U.S. Cl. ..... 382/232
(58) Field of Search ..... 382/232, 236, 382/238, 240, 242, 248, 250; 348/384.1, 394.1, 395.1, 400.1–404.1, 407.1–421.1, 425.2, 430.1–431.1; 375/240.23, 240.24

(56) References Cited

U.S. PATENT DOCUMENTS

| | | | | | |
|---|---|---|---|---|---|
| 5,317,672 | A | * | 5/1994 | Crossman et al. | 395/238 |
| 5,453,788 | A | * | 9/1995 | Matsushima et al. | 348/395 |
| 5,546,477 | A | * | 8/1996 | Knowles et al. | 382/242 |
| 5,687,157 | A | | 11/1997 | Imai et al. | 369/124 |
| 5,727,092 | A | * | 3/1998 | Sandford, II et al. | 382/251 |
| 5,818,970 | A | * | 10/1998 | Ishikawa et al. | 382/248 |
| 5,864,800 | A | | 1/1999 | Imai et al. | 704/229 |
| 6,002,794 | A | * | 12/1999 | Bonneau et al. | 382/166 |
| 6,009,203 | A | * | 12/1999 | Liu et al. | 382/233 |
| 6,064,698 | A | | 5/2000 | Koike | 375/242 |
| 6,069,865 | A | | 5/2000 | Imai | 369/124 |
| 6,243,496 | B1 | * | 6/2001 | Wilkinson | 382/245 |

FOREIGN PATENT DOCUMENTS

| | | | |
|---|---|---|---|
| JP | 1-267781 | 10/1989 | G06F/15/66 |
| JP | 5-130415 | 5/1993 | H04N/1/41 |
| JP | 5-176178 | 7/1993 | H04N/1/41 |
| JP | 6-252773 | 9/1994 | H03M/7/38 |
| JP | 6-290551 | 10/1994 | G11B/20/12 |
| JP | 7-30889 | 1/1995 | H04N/7/30 |
| JP | 8-125544 | 5/1996 | H03M/7/30 |
| JP | 8-186500 | 7/1996 | H03M/7/30 |
| JP | 9-135173 | 5/1997 | H03M/7/30 |
| JP | 10-79671 | 3/1998 | H03M/7/30 |
| JP | 10-149197 | 6/1998 | G10L/7/04 |

* cited by examiner

*Primary Examiner*—Jose L. Couso
(74) *Attorney, Agent, or Firm*—Sonnenschein, Nath & Rosenthal LLP

(57) ABSTRACT

A signal component coding circuit codes spectral components from a transform circuit for converting an audio signal to spectral components. A code string generation circuit generates a code string block of each unit time from the coded data from the signal component coding circuit. A compression rate change circuit changes the compression rate of the code string from the code string generation circuit, if necessary. For example, when the compression rate needs to be changed because of a change of the transmission capacity of a transmission line, the compression rate change circuit extracts codes of respective signal components from the code string, if necessary, and thus generates a code string having a changed compression rate. With such a structure, it is possible to solve the problem that processing to be carried out at a high speed such as real-time processing of compression rate change cannot be suitably carried out since an operation scale substantially similar to that of decoding and coding of an acoustic waveform signal is required in generating a code string having a changed compression rate from a code string outputted from a coding device.

30 Claims, 12 Drawing Sheets

CODING DEVICE, CODING METHOD, DECODING DEVICE, DECODING METHOD, PROGRAM RECORDING MEDIUM AND DATA RECORDING MEDIUM

TECHNICAL FIELD

This invention relates to a coding device and method for generating a code string by changing the compression rate of a code string generated by code string generation processing in accordance with limitation of the capacity of a transmission line or the like. The invention also relates to a decoding device and method for decoding a code string having the compression rate changed in accordance with the coding device and method. The invention also relates to a program recording medium for recording the coding method and the decoding method as software programs. The invention further relates to a data recording medium in which a code string having the compression rate changed in accordance with the coding method is recorded.

BACKGROUND ART

There are various techniques of high-efficiency coding of audio signals (including speech signals). For example, there is known a subband coding (SBC) technique, which is a non-blocked frequency subband coding system for splitting audio signals on the time base into a plurality of frequency bands and coding the plurality of frequency bands without blocking the audio signals, and a blocked frequency subband coding system, that is, a so-called transform coding system for converting (by spectrum conversion) signals on the time base to signals on the frequency base, then splitting the signals into a plurality of frequency bands, and coding the signals of each band. Also, a high-efficiency coding technique which combines the above-described subband coding and transform coding is considered. In this case, after band splitting is carried out in accordance with the subband coding, the signals of each band are spectrum-converted to signals on the frequency base and the spectrum-converted signals of each band are coded.

As a filter for the above-described band splitting, a QMF (quadrature mirror filter) is employed. This QMF filter is described in R. E. Crochiere, Digital coding of speech in subbands, Bell Syst. Tech. J. Vol. 55, No. 8, 1976. Also, a bandwidth filter splitting technique is described in Joseph H. Rothweiler, Polyphase Quadrature filters—A new subband coding technique, ICASSP 83, BOSTON.

As the above-described spectrum conversion, there is known spectrum conversion in which input audio signals are blocked on the basis of a predetermined unit time (frame) and converted from the tune base to the frequency base by carrying out discrete Fourier transform (DFT), discrete cosine transform (DCT) or modified discrete cosine transform (MDCT) for each block. MDCT is described in J. P. Princen, A. B. Bradley, Subband/Transform Coding Using Filter Bank Designs Based on Time Domain Aliasing Cancellation, Univ. of Surrey, Royal Melbourne Inst. of Tech., ICASSP 1987.

As the signals split into each band by filtering or spectrum conversion are thus quantized, a band where quantization noise is generated can be controlled and more auditorily efficient coding can be carried out by utilizing the characteristics such as a masking effect. If normalization is carried out for each band with the maximum value of absolute values of signal components in each band before quantization is carried out, more auditorily efficient coding can be carried out.

With respect to the frequency splitting width for quantizing each frequency component obtained by frequency band splitting, for example, band splitting in consideration of human auditory characteristics is carried out. Specifically, audio signals are split into a plurality of bands (for example, 25 bands) with a bandwidth broader in higher frequency areas, generally referred to as critical bands. In coding the data of each band in this case, predetermined bit distribution for each band or adaptive bit allocation for each band is carried out. For example, in coding coefficient data obtained by MDCT processing by using bit allocation, the MDCT coefficient data of each band obtained by MDCT processing for each block is coded with an adaptive number of allocated bits. Two techniques for such bit allocation are known.

One technique is disclosed in R. Zelinski and P. Noll, Adaptive Transform Coding of Speech Signals, IEEE Transactions of Acoustics, Speech, and Signal Processing, vol. ASSP-25, No. 4, August 1977. In this technique, bit allocation is carried out on the basis of the magnitude of signals of each band. In accordance with this technique, the quantization noise spectrum is flat and the noise energy is minimum. However, since the masking effect is not utilized auditorily, the actual sense of noise is not optimum.

The other technique is disclosed in M. A. Kransner, The critical band coder—digital encoding of the perceptual requirements of the auditory system, MIT, ICASSP 1980. In this technique, fixed bit allocation is carried out by utilizing the auditory masking effect and thus obtaining a necessary signal-to-noise ratio for each band. In this technique, however, since bit allocation is fixed, a satisfactory characteristic value is not obtained even when characteristics are measured with a sine-wave input.

In order to solve these problems, there is proposed a high-efficiency coding device for divisionally using all the bits usable for bit allocation, for a predetermined fixed bit allocation pattern of each subblock and for bit distribution depending upon the magnitude of signals of each block, and causing the division ratio to depend upon the signals related with input signals so that the division rate for the fixed bit allocation is increased as the spectrum of the signals becomes smoother.

According to this method, in the case where the energy is concentrated at a specified spectrum as in a sine wave input, a large number of bits are allocated to a block including that spectrum, thereby enabling significant improvement in the overall signal-to-noise characteristic. Since the human auditory sense is generally acute to a signal having a steep spectral component, improvement in the signal-to-noise characteristic by using such a method not only leads to improvement in the numerical value of measurement but also is effective for improving the sound quality perceived by the auditory sense.

In addition to the foregoing methods, various other methods for bit allocation are proposed. Therefore, if a fine and precise model with respect to the auditory sense is realized and the capability of the coding device is improved, auditorily more efficient coding can be carried out.

For example, the present Assignee has proposed a method for separating tonal components which are particularly important in terms of the auditory sense from spectral signals and coding these tonal components separately from the other spectral components. Thus, it is possible to efficiently code audio signals at a high compression rate without generating serious deterioration in the sound quality perceived by the auditory sense.

In the case where DFT or DCT is used as a method for converting waveform signals to the spectrum, M units of independent real-number data are obtained by carrying out conversion with a time block consisting of M samples. In general, M1 samples of each of adjacent blocks are caused to overlap each other in order to reduce connection distortion between time blocks. Therefore, in DFT or DCT, M units of real-number data are quantized and coded with respect to (M-M1) samples on the average.

On the other hand, in the case where MDCT is used as a method for conversion to the spectrum, M units of independent real-number data are obtained from 2M samples having M samples caused to overlap M samples of the adjacent period. Therefore, M units of real-number data are quantized and coded with respect to M samples on the average.

In a decoding device, waveform elements obtained by inversely converting each block of codes thus obtained by using MDCT are added to each other while being caused to interfere with each other. Thus, waveform signals can be reconstituted.

In general, by elongating the time block for conversion, the frequency resolution of spectrum is increased and the energy is concentrated at a specified spectral component. Therefore, more efficient coding than in the case where DFT or DCT is used can be carried out by using MDCT in which adjacent blocks are caused to overlap each other by half so as to carry out conversion with a large block length and in which the number of resultant spectral signals is not increased from the number of original time samples. Also, the inter-block distortion of waveform signals can be reduced by causing adjacent blocks to have sufficiently long overlap.

In actual generation of a code string, first, quantization precision information and normalization coefficient information are coded with a predetermined number of bits for each band to be normalized and quantized, and then the normalized and quantized spectral signals may be coded.

For coding spectral signals, a method using a variable-length code such as a Huffman code is known. The Huffman code is described in David A. Huffman, A Method for Construction of Minimum Redundancy Codes, Proceedings of the I. R. E., pp. 1098–1101, September 1952.

Generally, with respect to a code string generated by a coding device, sub information S made up of the quantization precision and normalization coefficient and main information M made up of the quantization spectrum are arranged in this order, as shown in FIG. 1, in each code string block constituted by coded data obtained by coding a time signal for each predetermined time. The sub information S is auxiliary information for restoring original spectral components and includes a plurality of parameters such as sub information S1, S2, . . . , Sn.

Meanwhile, in some cases, a code string having the compression rate changed in accordance with a change of the transmission line capacity of a transmission medium is produced from a code string which is once generated. In general, in regenerating a code string having a changed compression rate from a predetermined code string, the predetermined code string is once decomposed, and decomposition of the code string and decoding of signal components are carried out for adjusting the number of bits. Then, calculation for bit redistribution and change of the quantization precision and normalization coefficient are carried out in addition to limitation of the frequency band. Then, re-quantization and generation of a code string are carried out.

In the conventional method, however, in generating a code string having a changed compression rate from a code string outputted from the coding device, the operation scale substantially similar to that of decoding and coding of acoustic waveform signals is required. Therefore, the conventional method is not suitable for processing which requires high-speed operation, for example, real-time processing for converting the compression rate.

DISCLOSURE OF THE INVENTION

In view of the foregoing status of the art, it is an object of the present invention to provide a coding device and method which enables generation of a code string having a compression rate changed at a high-speed with a small quantity of operation.

In view of the foregoing status of the art, it is another object of the present invention to provide a decoding device and method for decoding a code string having a compression rate changed at a high speed with a small quantity of operation.

It is still another object of the present invention to provide a program recording medium in which a program enabling generation of a code string having a compression rate changed at a high speed with a small quantity of operation is recorded, and a program recording medium in which a program enabling decoding of the code string is recorded.

It is a further object of the present invention to provide a data recording medium in which a code string having a compression rate changed at a high speed with a small quantity of operation is recorded.

In order to solve the foregoing problems, in a coding device and method according to the present invention, when a code string is to be generated from an input signal, a code string equivalent to minimum necessary information for decoding an entire code string block equivalent to a frame, that is, each time unit, is arranged at a leading part of the code string block. In the remaining part, codes such as a normalization coefficient, the number of quantization steps and a spectrum coefficient corresponding to a partial spectral component are collectively used as a unit, and code strings are stored in the order from a code string of the highest importance for decoding a part of the code string block.

Then, a code string having a different length in accordance with a selected compression rate is cut out from the leading part of the code string block of each unit time, thus enabling regeneration of a code string of a different length. Therefore, a code string having a changed compression rate can be generated at a high speed with a small quantity of operation or a simple structure.

Also, in a decoding device and method according to the present invention, to decode codes generated by coding a signal of each predetermined unit time on the side of a coding device, a code string having partial code strings, including auxiliary data for decoding generated for each of a plurality of frequency bands from the codes on the side of the coding device and main data expressing components of the signal, arrayed in a predetermined order from a leading part of a code string block of each predetermined unit time is decomposed into the codes, and an output signal is generated on the basis of the codes obtained by decomposition.

Also, in a program recording medium according to the present invention, a coding program is recorded. The coding program includes a transform step of converting an input signal to a plurality of units of information of each frequency band, a coding step of coding the information of each band from the transform step, and a code string generation step of generating a plurality of partial code strings made up of auxiliary data and main data with respect to codes equivalent to information of each predetermined unit time from the coding step and rearranging the partial code strings in the order from a partial code string of the highest importance from a leading part of a code string block of each predetermined unit time, thus generating a code string.

Also, in a program recording medium according to the present invention, a decoding program for decoding codes generated by coding a signal of each predetermined unit time on the side of a coding device is recorded. The decoding program includes a decomposition step of decomposing into the codes a code string having partial code strings, including auxiliary data for decoding generated for each of a plurality of frequency bands from the codes on the side of the coding device and main data expressing components of the signal, arrayed in a predetermined order from a leading part of a code string block of each predetermined unit time, and a signal generation step of generating an output signal on the basis of the codes obtained by decomposition of the decomposition step.

Moreover, in a data recording medium according to the present invention, a code string is recorded. The code string is generated by converting an input signal to a plurality of units of information of each of a plurality of frequency bands, coding the information of each band, forming a plurality of partial code strings made up of auxiliary data and main data with respect to codes equivalent to information of each predetermined unit time, and rearranging the plurality of partial code strings in the order from a partial code string of the highest importance from a leading part of a code string block of each predetermined unit time.

BEST MODE FOR CARRYING OUT THE INVENTION

A preferred embodiment of the coding device and method according to the present invention will now be described with reference to the drawings. As a matter of course, the description of the embodiment is not intended to limit each means.

Figure 1:
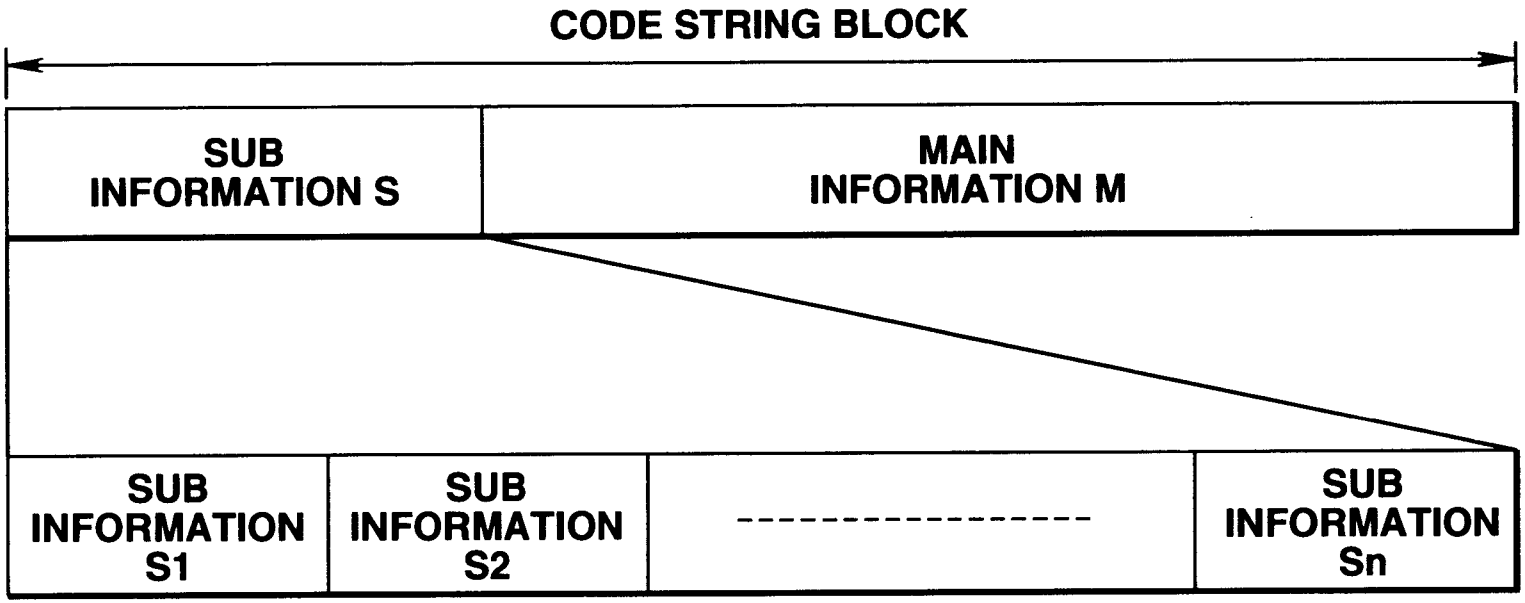
FIG. 1 shows the format of a code string block generated by a conventional coding device.
Figure 2:
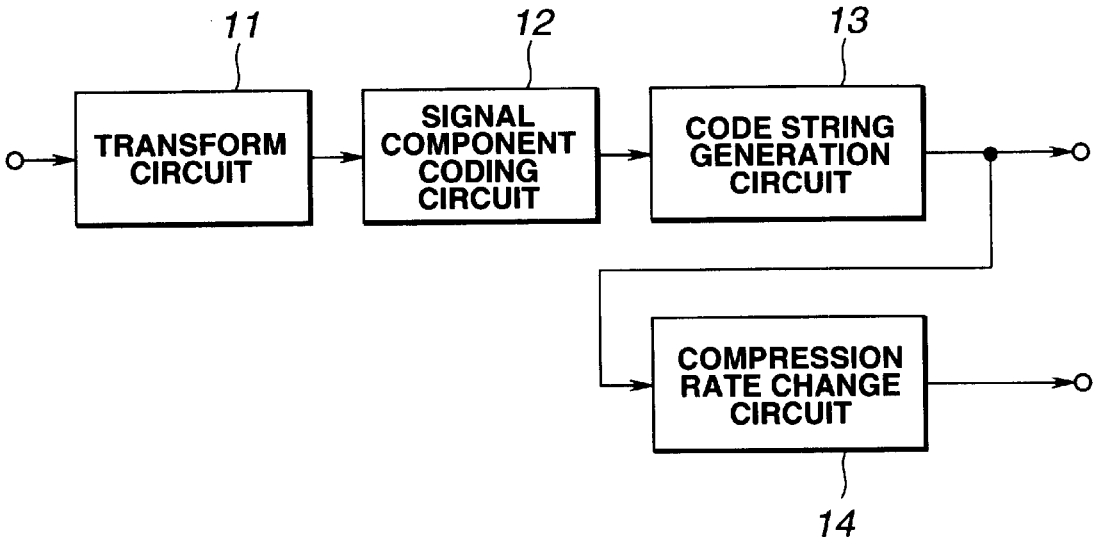
FIG. 2 is a block diagram showing an audio coding device as an embodiment of the coding device and method according to the present invention.

In this embodiment, an audio coding device for coding an audio signal and outputting a compressed code string is employed. This audio coding device has a transform circuit 11 for converting an audio signal to spectral components, a signal component coding circuit 12 for coding the spectral components from the transform circuit 11, a code string generation circuit 13 for generating a code string block of each unit time from the coded data from the signal component coding circuit 12, and a compression rate change circuit 14 for changing, if necessary, the compression rate of the code string from the code string generation circuit 13, as shown in FIG. 2. Normally, the code string from the code string generation circuit 13 is outputted as it is. However, for example, when the compression rate must be changed because of a change of the transmission capacity of a transmission line, the code of each signal component is extracted from the code string by the compression rate change circuit 14, if necessary, and a code string having a changed compression rate is generated.

Figure 3:
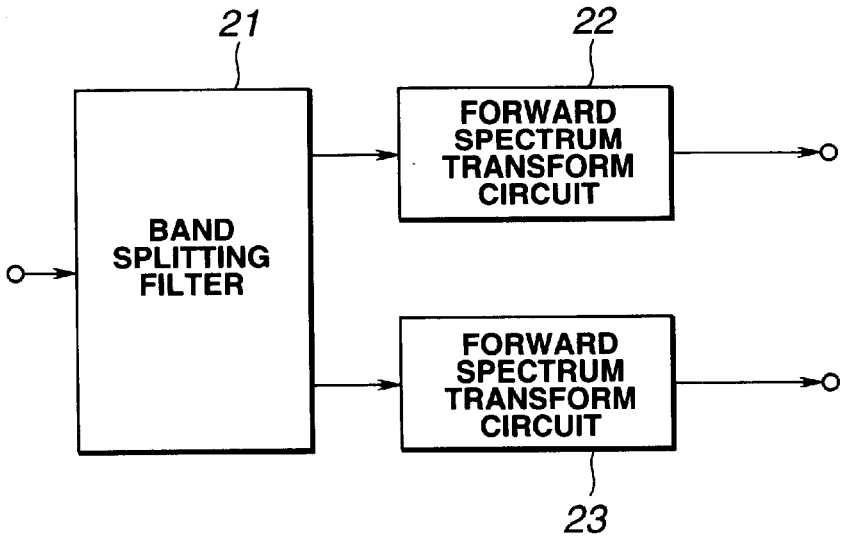
FIG. 3 is a block diagram showing details of a transform circuit constituting the audio coding device.

The transform circuit 11 has a band splitting filter 21 for splitting an inputted audio signal into signals of two frequency bands, and a forward spectrum transform circuit 22 and a forward spectrum transform circuit 23 for converting the audio signals of two bands obtained by splitting by the band splitting filter 21 to spectral components, as shown in FIG. 3.

The output of the band splitting filter 21 has a frequency band which is ½ of the frequency band of the input audio signal, and the number of data is also decimated to ½. The forward spectral transform circuits 22 and 23 convert the inputted audio signals of the respective bands to spectral signal components by modified discrete cosine transform (MDCT).

As the transform circuit 11, many other structures than the structure shown in FIG. 3 may be considered. For example, an inputted audio signal may be converted by DFT or DCT instead of MDCT. In this embodiment, in order to realize effective action particularly in the case where the energy is concentrated at a specified frequency, it is convenient to employ a method for converting an inputted audio signal to frequency components by the above-described spectrum conversion in which a large number of frequency components can be obtained with a relatively small quantity of operation.

The signal component coding circuit 12 performs time domain quantization noise shaping, intensity stereo processing, prediction, M/S stereo processing, normalization and quantization on a predetermined spectral component from the transform circuit 11, and outputs various parameters and spectrum information such as quantization precision information, normalization coefficient information and the like as coded data. Specifically, quantized spectrum information of each unit time, that is, main information M, and (n kinds of) sub information S such as quantization precision information, normalization coefficient information and the like for decoding the main information M are outputted as coded data.

Figure 4:
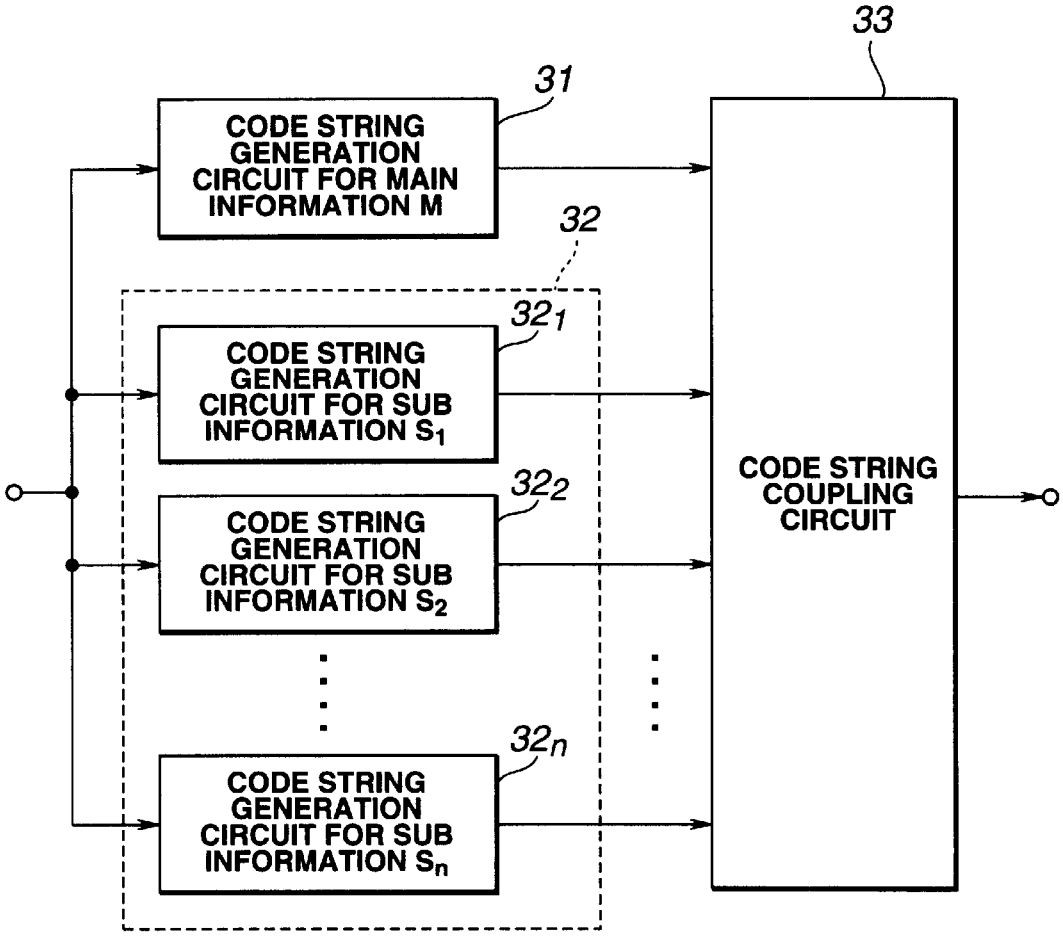
FIG. 4 is a block diagram showing details of a code string generation circuit constituting the audio coding device.

In the code string generation circuit 13, the spectrum information as the coded data outputted from the signal component coding circuit 12 is received as main information M by a main information code string generation circuit 31, and the quantization precision information. normalization coefficient information and the like as coded data are received as (n kinds of) sub information S by sub information code string generation circuits $\mathbf{32}_1$, $\mathbf{32}_2$, . . . , $\mathbf{32}_n$, as shown in FIG. 4. Each of the code string generation circuits 31, $\mathbf{32}_1$, $\mathbf{32}_2$, . . . , $\mathbf{32}_n$, generates a code string by a method suitable for each information. Then, the codes strings are coupled by a code string coupling circuit 33, thus generating a code string block of each unit time. In this case, the code strings in the code string block are rearranged in the order from the highest importance from the leading part.

The compression rate change circuit 14 cuts out the code strings generated by the code string generation circuits 31 and 32 of the code string generation circuit 13, with different lengths from the leading part of the code string block of each unit time, thus generating code strings having different compression rates.

The operation of the audio coding device of the above-described structure will now be described. The band splitting filter 21 of the transform circuit 11 splits an inputted audio signal into a component of a higher frequency band and a component of a lower frequency band, and outputs the components to the forward spectrum transform circuit 22 and the forward spectrum transform circuit 23, respectively. The forward spectrum transform circuit 22 converts the inputted frequency band component to a spectral signal component by MDCT. The forward spectrum transform circuit 23 also executes processing similar to that of the forward spectrum transform circuit 22.

Figure 5:
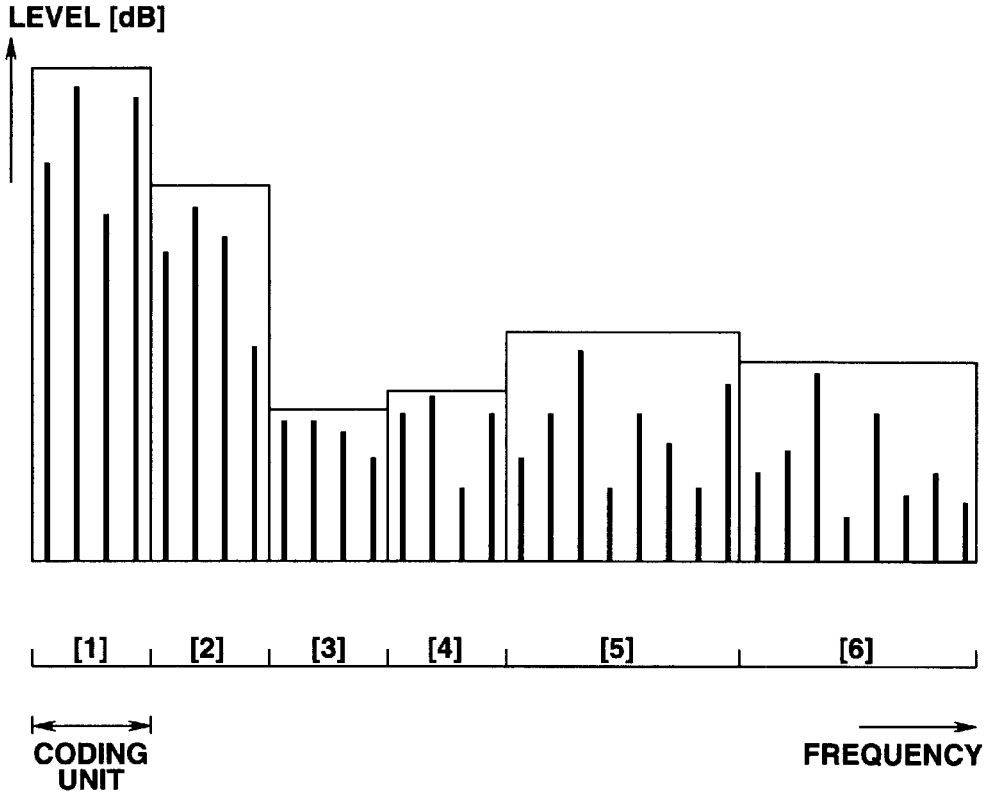
FIG. 5 shows the level of absolute value of spectral components from the transform circuit, in decibel.

FIG. 5 shows an example in which the levels of absolute values of the spectral components from the forward spectrum transform circuits 22 and 23 are converted to decibel (dB). In this example, an inputted audio signal is converted to 32 spectral signals of each unit time by the forward spectrum transform circuits 22 and 23. The spectral signals are grouped into six coding units [1] to [6].

The signal component coding circuit 12 performs normalization and quantization on the spectral components grouped in the six coding units [1] to [6]. Specifically, the maximum value is found for each coding unit, and the other spectral values in the unit are divided and normalized by using the maximum value or a greater value as a normalization coefficient. Also, the quantization precision is determined for each unit of the inputted spectral signals, and the normalized spectral signals are quantized on the basis of the quantization precision.

By varying the quantization precision of each coding unit depending upon the distribution of frequency components, auditorily efficient coding so as to restrain deterioration of the sound quality to the minimum can be carried out. The quantization precision information necessary in each coding unit is found, for example, by calculating the minimum audible level or the masking level in a band corresponding to each coding unit on the basis of the auditory model. The normalized and quantized spectral signals are converted to variable-length codes and are coded together with the quantization precision information and normalization coefficient information for each coding unit. Then, the signal component coding circuit 12 outputs quantized spectrum information of each unit time, that is, main information M, and other information, that is, (n kinds of) sub information S.

Figure 6:
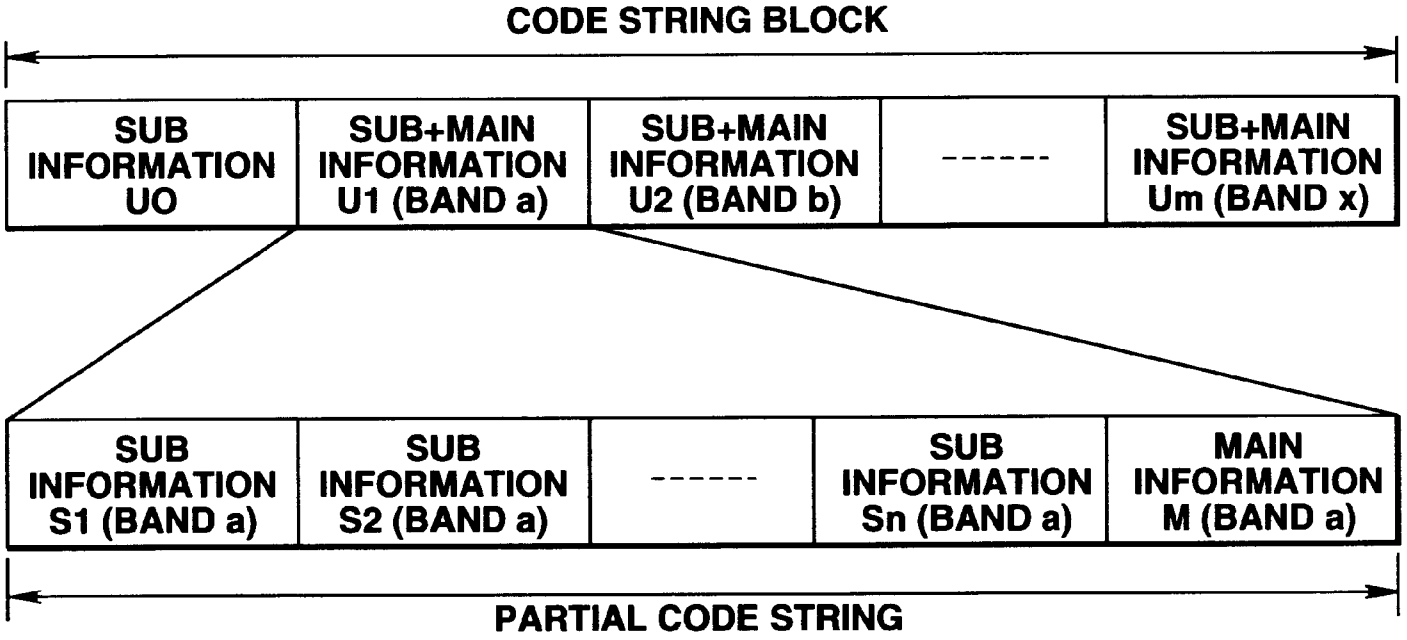
FIG. 6 shows the format of an exemplary code string block generated by the code string generation circuit.

In the code string generation circuit 13, the code string generation circuit 31 for main information M of FIG. 4 generates a main code string from the main information M. Also, in the code string generation circuit 13, the sub information code string generation circuits $\mathbf{32}_1$, $\mathbf{32}_2$, . . . , $\mathbf{32}_n$ of FIG. 4 generate sub code strings from the n kinds of sub information S. The main code string and the sub code strings are coupled by the code string coupling circuit 33, as shown in FIG. 6. In FIG. 6, the main code string is expressed as main information and the sub code string is expressed as sub information. Therefore, in the following description, the main information and the sub information after the code string generation by the code string generation circuit 13 are described as main information (main code string) and sub information (sub code string). The code string coupling circuit 33 arranges the minimum necessary information U0 for decoding an entire code string block at the leading part of the code string block of each unit time.

Specifically, in FIG. 6, the sub information U0 used for decoding the entire code string block, for example, a code string related with codes corresponding to the code string block length and the number of channels, is arranged at the leading part of the code string block of each unit time. However, the code string block length and the number of channels described in this example are not prescribed as the minimum necessary information. In the remaining part, codes consisting of information corresponding to each coding unit, for example, sub information (sub code strings S1 to Sn) such as the normalization coefficient and the number of quantization steps and information corresponding to partial spectral components of the spectrum coefficient (main information or main code string M), are used as one unit, that is, as a partial code string U. Partial code strings U are rearranged in the order from a partial code string of the highest importance at the time of decoding from the leading part of the frame, for example, in the order of partial code strings U1, U2, . . . , Um. However, all the elements of the sub information (sub code strings) S1 to Sn are not necessarily included in the partial code string U as one unit, and unnecessary sub information (sub code strings) might not be stored therein. In addition, the number m of partial code strings U1 to Um is not necessarily coincident with the number of coding units, and the information of coding units of low importance might not be stored.

As an example of arrangement, unit code strings are arranged in the order from a unit code string corresponding to a low-frequency component to a unit code string corresponding to a high-frequency component, as shown in (A) in the following Table 1. Specifically, the sub information (sub code strings) and the main information (main code string) are arranged in the code string block in the order of coding units [1], [2], [3], [4], [5] and [6].

TABLE 1

| Sub + Main Information Unit U | (A) In the Order of Frequency Bands, Low to High | (B) In the Order from Large Normalization Coefficient | (C) In the Order from High Quantization Precision |
|---|---|---|---|
| U1 | [1] | [1] | [2] |
| U2 | [2] | [2] | [3] |
| U3 | [3] | [5] | [5] |
| U4 | [4] | [6] | [1] |
| U5 | [5] | [4] | [4] |
| U6 | [6] | [3] | [6] |

In this method, as information from the leading part of the code string block of each unit time up to a halfway part is decoded, acoustic information having a band limited from the low-frequency side important for reproduction of the acoustic information can be taken out.

As another example of arrangement, unit code strings are arranged in the order from a unit code string corresponding to a coding unit having large spectral energy, that is, a large normalization coefficient, to a unit code string corresponding to low energy, as shown in (B) in Table 1. Specifically, the sub information (sub code strings) and the main information (main code string) are arranged in the code string block in the order of coding units [1], [2], [5], [6], [4] and [3]. In this method, as information from the leading part of each code string block up to a halfway part is decoded, information of a tonal component can be preferentially taken out in coding a tonal signal in which the spectral energy is concentratively distributed.

As still another example of arrangement, unit code strings are arranged in the order from a unit code string corresponding to information of a band which needs to have high quantization precision because of the acoustic sense, that is, a unit code string corresponding to a coding unit having high quantization precision, to a unit code string corresponding to low quantization precision, as shown in (C) in Table 1. Specifically, the sub information (sub code strings) and the main information (main code string) are arranged in the code string block in the order of coding units [2], [3], [5], [1], [4] and [6]. In this method, as information from the leading part of each code string block up to a halfway part is decoded, acoustic information of a band having high necessity of reducing quantization noise perceived by the auditory sense can be preferentially taken out in coding a noise signal having relatively flat distribution of spectral energy.

Figure 7:
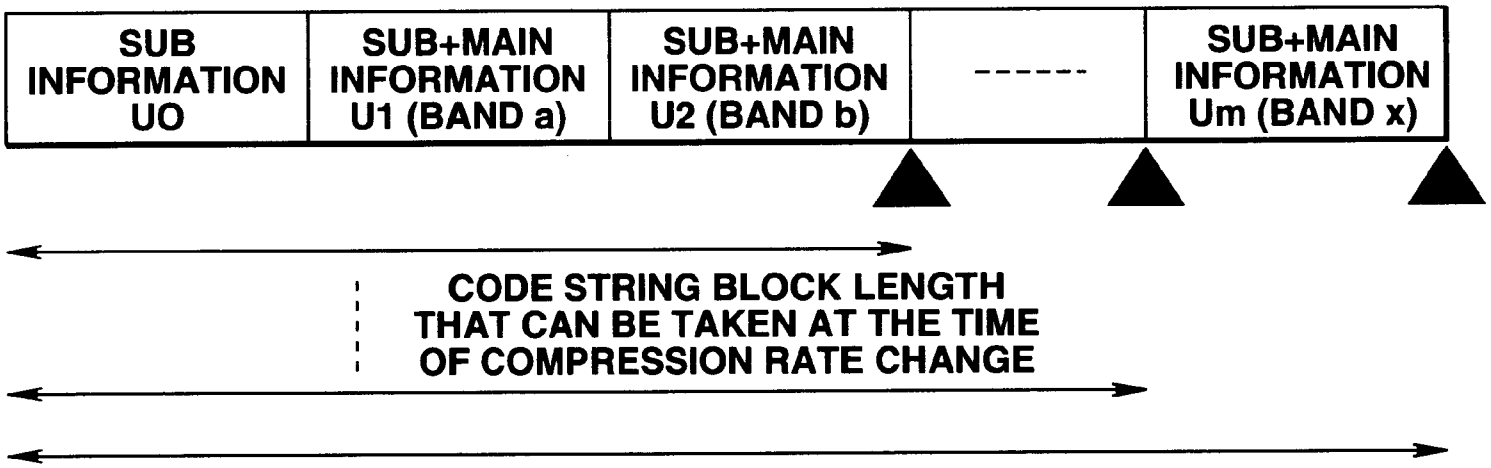
FIG. 7 shows the format of another exemplary code string block generated by the code string generation circuit.

FIG. 7 shows another exemplary structure of a code string block of each unit time outputted from the code string coupling circuit 33 of the code string generation circuit 13. The procedure for arrangement of code strings is substantially the same as the procedure shown in FIG. 6. However, this example differs from that of FIG. 6 in that the position of the boundary between unit code strings is partly predetermined. In the case where the value of each code string block length that should be employed is limited to several kinds in advance with respect to code strings generated by the compression rate change circuit 14, this boundary position is equivalent to each code string block length. To produce this type of code string block, the signal component coding circuit 12 and the code string generation circuit 13 recognize the boundary position and adjust the boundary position of the code strings outputted from the code string generation circuit 13.

Figure 8:
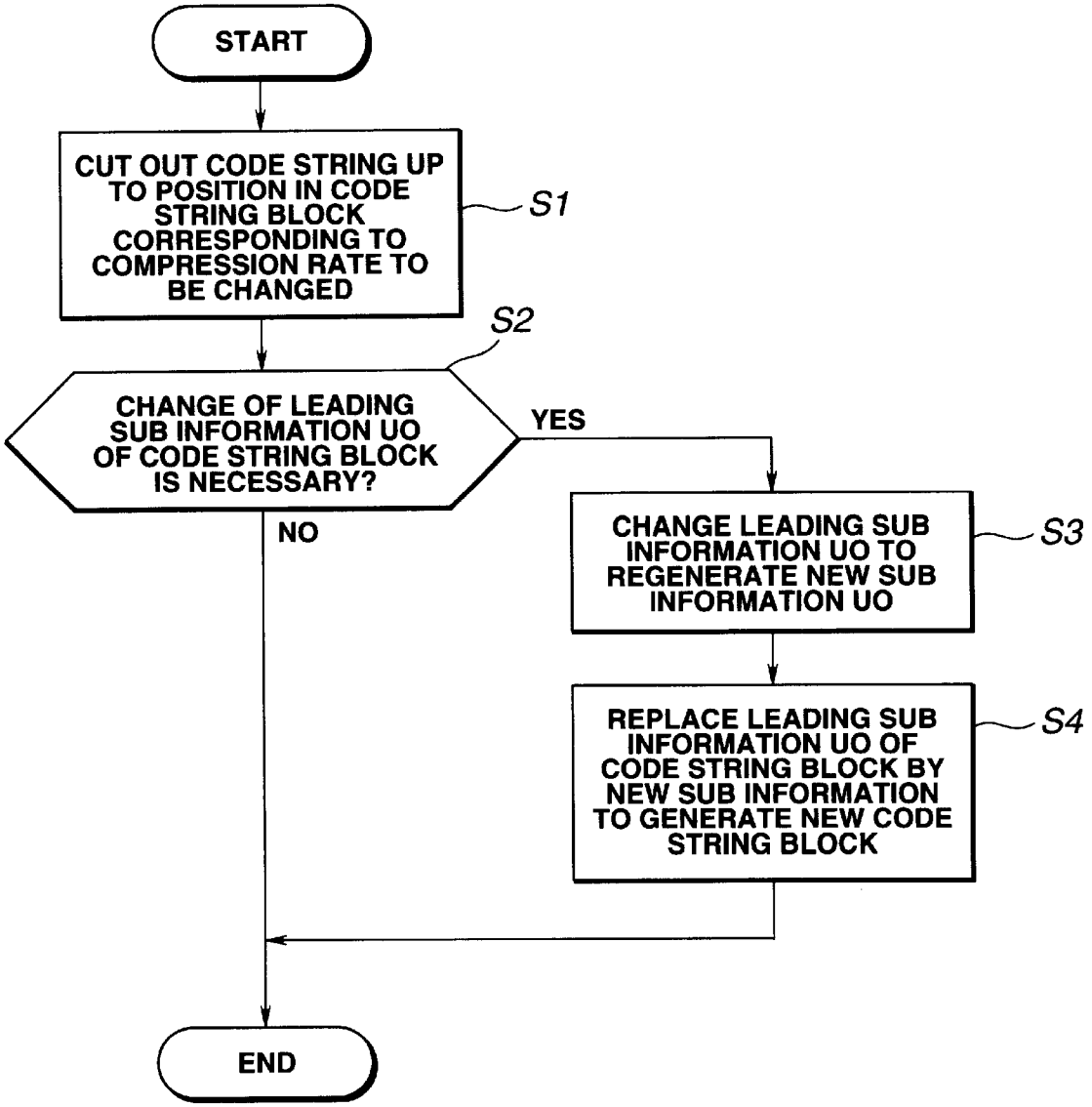
FIG. 8 is a flowchart for explaining the flow of processing in a compression rate change circuit constituting the audio coding device.

Normally, the code strings, shown in FIG. 6, from the code string generation circuit 13 is outputted as it is. However, when the compression rate is to be changed because of a change of the transmission capacity of the transimssion line, the compression rate change circuit 14 is used. The flow of processing in the compression rate change circuit 14 will now be described with reference to FIG. 8.

First, at step S1, the compression rate change circuit 14 cuts out code strings from the leading part of the code string block of each unit time up to a position in the code string block corresponding to the compression rate or data quantity (number of bytes) to be changed.

Next, at step S2, it is checked whether or not sub information U0 of the leading part of the code string block needs to be changed because of change of the compression rate. Specifically, there is a possibility that information such as the code string block length and band information of a code string block to be newly generated needs to be changed because the code strings are cut out. Thus, it is discriminated whether or not the information needs to be changed. If the result is YES, the processing goes to step S3. If the result is NO, the code string block which is newly generated by cutting out is outputted and the processing ends.

Next, at step S3, codes corresponding to the sub information U0 which must be changed because of change of the compression rate, for example, codes corresponding to the code string block length information and band information are decoded from the code strings and the information is changed and re-coded, thus generating a new sub information U0 code string.

In the case of the structure of code string block shown in FIG. 6, the last part of the code strings cut out at step S1 may be different from the boundary of sub+main information (partial code string) and may not be correctly decoded depending upon the coding system. In such a case, a part of the sub+main information that is effective at the time of decoding is checked from the cut-out code strings, and the sub information at the leading part is changed. That is, the end of the last partial code string is checked, and band information and the like of the sub information U0 is set on the basis of the information about the end.

In the case of the structure of code string block shown in FIG. 7, since the last part of the code strings cut out at step S1 is coincident with the boundary of sub+main information (partial code string), checking operation of the sub+main information part is not necessary. Thus, in comparison with the frame structure of FIG. 6, the arithmetic processing at the time of changing the compression rate can be reduced.

Then, at step S4, the compression rate change circuit 14 replaces the old sub information U0 with the new sub information U0 generated at step S3, and thus couples the new sub information U0 with the subsequent information (U1 and subsequent thereto), thereby generating the new code string block having the changed compression rate. Thus, the processing ends when the code strings are regenerated by changing the code string block length for each unit time.

In the above description, the new sub information U0 is generated to replace the old sub information U0. However, in the case where fixed-length coding is used, a portion to be corrected with the codes in the sub information U0 can be directly rewritten. By employing such a structure, a temporary buffer required in the processing of FIG. 8 can be reduced and efficient processing can be carried out.

By thus cutting out code strings from the leading part of the code string block of each unit time up to the position in the code string block corresponding to the compression rate to be changed and then changing only the information of sub information U0 at the leading part, re-decoding and re-coding of acoustic waveform need not be carried out and the quantity of operation can be reduced.

Figure 9:
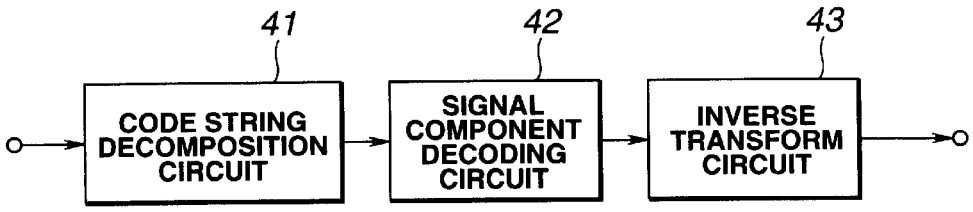
FIG. 9 is a block diagram showing the structure of an exemplary decoding device for decoding an audio signal from a code string generated by the audio coding device shown in FIG. 2.

FIG. 9 shows an exemplary structure of a decoding device for decoding and outputting an audio signal from the code string generated by the audio coding device shown in FIG. 2. In this decoding device, an inputted code string is decomposed by a code string decomposition circuit 41 and codes of respective signal components are extracted. The extracted codes of signal components are supplied to a signal component decoding circuit 42. The signal component decoding circuit 42 decodes (or inversely quantizes) an inputted signal and outputs the decoded signal to an inverse transform circuit 43. The inverse transform circuit 43 converts inputted spectral signal components to an acoustic waveform signal and outputs the acoustic waveform signal.

Figure 10:
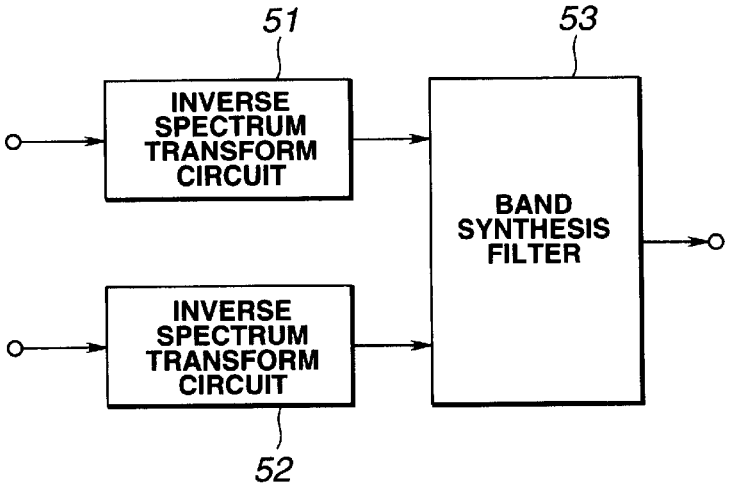
FIG. 10 is a block diagram showing details of an inverse transform circuit constituting the decoding device.

FIG. 10 shows an exemplary structure of the inverse transform circuit 43. As shown in FIG. 10, spectral signal components of respective bands supplied from the signal component decoding circuit 42 are converted to acoustic signal components by inverse spectrum transform circuits 51 and 52 and are then synthesized by a band synthesis filter 53.

The operation of the decoding device of the above-described structure will now be described. The code string decomposition circuit 41 is supplied with the code string shown in FIG. 6 or FIG. 7. The code string decomposition circuit 42 decomposes the inputted code string and supplies codes obtained by decomposition to the signal component decoding circuit 42. The signal component decoding circuit 42 inversely quantizes an inputted signal (main information M) by using quantization precision information and normalization coefficient information (sub information S1 to Sn) which are inputted at the seine time. The inversely quantized signal is inputted to the inverse spectrum transform circuits 51 and 42 of the inverse transform circuit 43, where the spectral signals are converted to audio signals by inverse MDCT processing. The audio signals of respective bands outputted from the inverse spectrum transform circuits 51 and 52 are synthesized by the band synthesis filter 53, and an audio signal is outputted.

When the code string from the coding device is transmitted to the decoding device through a transmission line such as a network, if the transmission capacity of the transmission line is small, the code string block as described with reference to FIGS. 6 and 7 is transmitted. In this case, the decoding device shown in FIG. 9 decodes the code string block.

Figure 11:
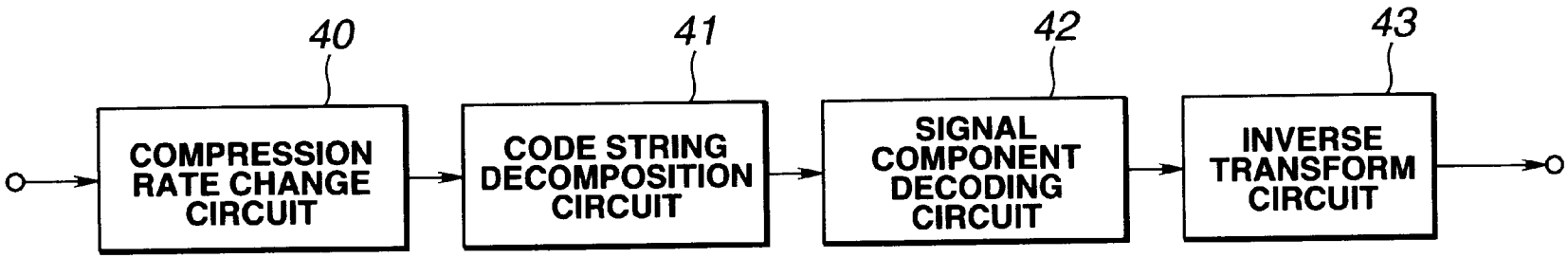
FIG. 11 is a block diagram showing the structure of another exemplary decoding device for decoding an audio signal from a code string generated by the audio coding device shown in FIG. 2.

On the contrary, when the code string from the code string generation circuit 13 is transmitted to the decoding device without having any change of the compression rate in the case where the transmission capacity of the transmission line is sufficiently large, if the decoding device does not have the capability to decode the code string in real time for continuously reproduction, a compression rate change circuit 40 may be provided as shown in FIG. 11 so that decoding is carried out after the compression rate is changed by cutting out data from the code string as described above. The operation of the compression rate change circuit 40 is equivalent to the operation of the compression rate change circuit 14 described with reference to FIG. 8. However, the compression rate is not determined in accordance with the transmission capacity but is determined by the load factor of the coding device based on the processing capability of the decoding device, that is, the CPU power and memory capacity that can be allocated for decoding processing.

When the code string block from the code string generation circuit 13 of the coding device is inputted to the decoding device as shown in FIG. 11 through a randomly accessible disk-shaped recording medium, the decoding device reads the leading part of the code string block of each unit time by using the compression rate change circuit 40, thus enabling reproduction of data having a changed compression rate.

Figure 12:
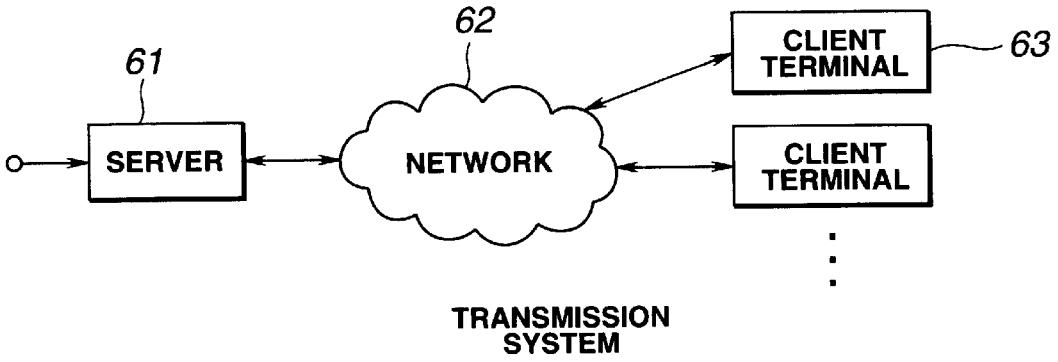
FIG. 12 shows an exemplary structure of an embodiment of a transmission system to which the present invention is applied.

FIG. 12 shows an exemplary structure of an embodiment of a transmission system to which the present invention is applied. (The system in this case means a logical collection of a plurality of devices regardless of whether or not the devices of respective structures are provided in the same casing.)

In this transmission system, when a request for an audio signal such as a music tune is sent from a client terminal 63 to a server 61 through a network 62 such as the Internet, ISDN (integrated service digital network), LAN (local area network) or PSTN (public switched telephone network), coded data obtained by coding an audio signal corresponding-to the requested tune by using the above-described coding method in the server 61 is transmitted to the client terminal 63 through the network 62. The client terminal 63 receives the coded data from the server 61, and decodes and reproduces the coded data in real time (streaming reproduction).

Figure 13:
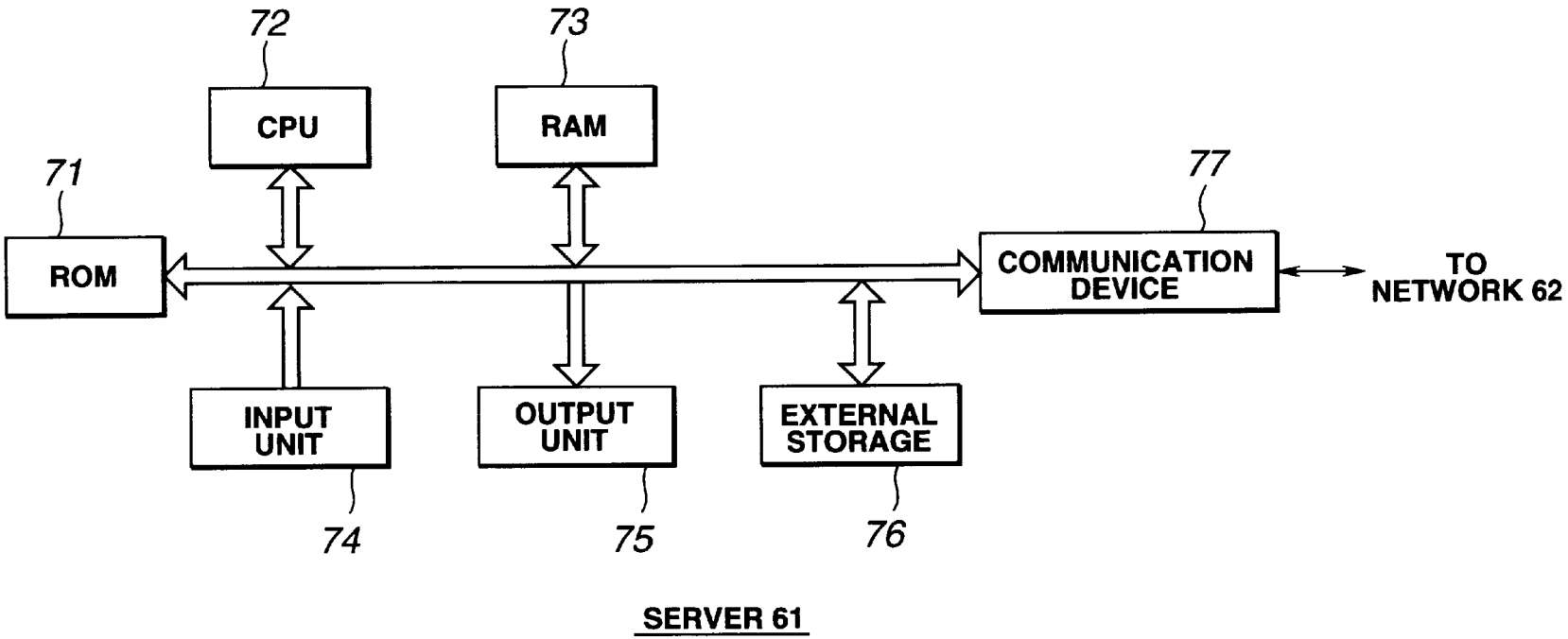
FIG. 13 is a block diagram showing an exemplary hardware structure of a server 61 of FIG. 12.

FIG. 13 shows an exemplary hardware structure of the server 61 of FIG. 12.

In a ROM (read only memory) 71, for example, an IPL (initial program loading) program is stored. A CPU (central processing unit) 72 executes a program of OS (operating system) stored or recorded in an external storage 76, for example, in accordance with the IPL program stored in the ROM 71, and also executes various application programs stored in the external storage 76 under the control of the OS. Thus, the CPU 72 carries out the audio signal coding processing described with reference to FIGS. 2 to 8 and the transmission processing of coded data obtained by the coding processing to the client terminal 63. A RAM (random access memory) 73 stores programs and data necessary for the operation of the CPU 72. An input unit 74 is constituted by a keyboard, a mouse, a microphone, an external interface and the like, and is operated for inputting necessary data or commands. The input unit 74 also functions as an interface for accepting input of a digital audio signal provided to the client terminal 63 from outside. An output unit 75 is constituted by a display, a speaker, a printer and the like, and displays or outputs necessary information. The external storage 76 is constituted, for example, by a hard disk, and stores the above-described OS and application programs. The external storage 76 also stores data necessary for the operation of the CPU 72. A communication device 77 performs control necessary for communication through the network 62.

Figure 14:
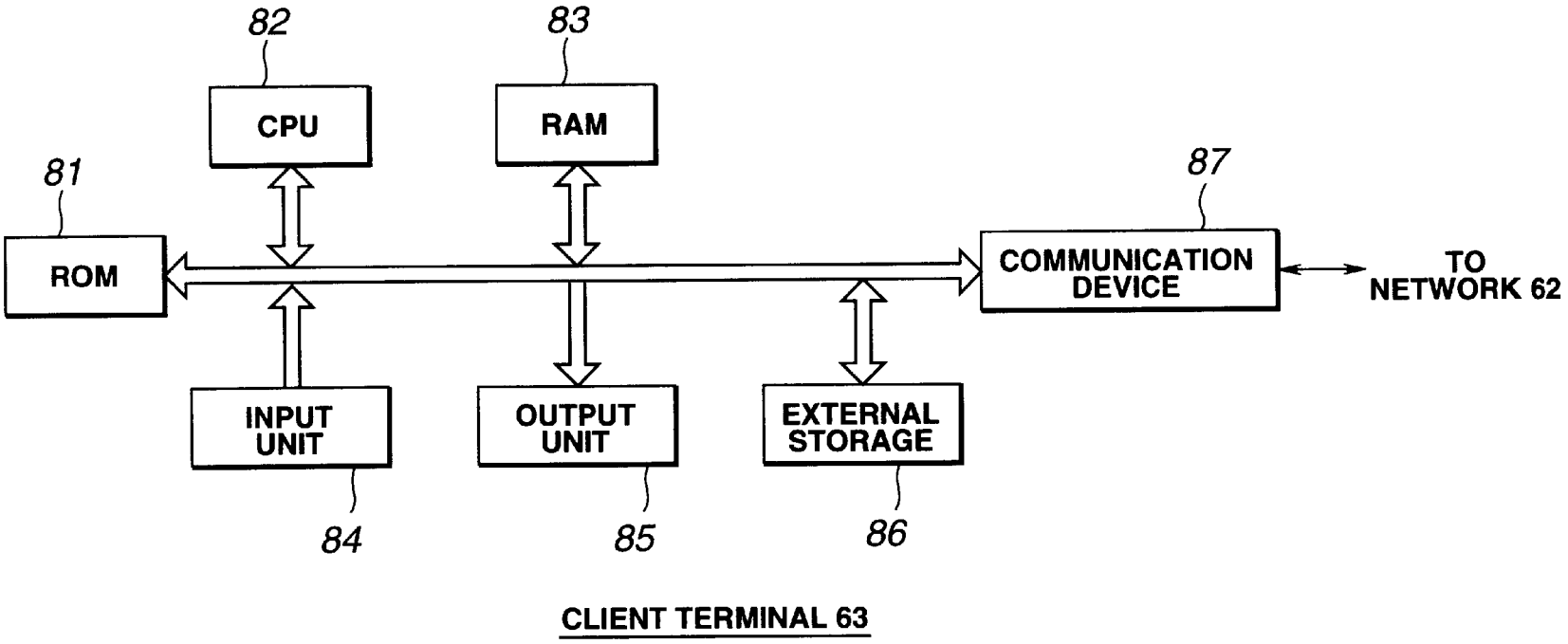
FIG. 14 is a block diagram showing an exemplary hardware structure of a client terminal 63 of FIG. 12.

FIG. 14 shows an exemplary hardware structure of the client terminal 63 of FIG. 12.

The client terminal 63 is constituted by elements including a ROM 81 to a communication device 87, basically similarly to the server 61 constituted by the elements including the ROM 71 to the communication device 77.

However, the external storage 86 stores a program for decoding coded data from the server 61 and a program for carrying out processing that will be described later, as application programs. The CPU 82 executes these application programs, thereby carrying out decoding and reproduction processing of coded data described with reference to FIGS. 9 to 11.

In the above-described embodiment, the server 61 transmits a coded audio signal to the client terminal 63 through the network 62. However, a recordable medium such as an optical recording medium, a magneto-optical recording medium or a magnetic recording medium may be used as the external storage 76 so that the coded audio signal is recorded on this recording medium. In this case, the coded audio signal recorded on the recording medium is read out by the external storage 86 of the client terminal 63. The read-out signal is processed by the decoding processing and is reproduced as an audio signal by the client terminal 63.

The specific example of the coding device according to the present invention is described above. However, the present invention can be applied not only to transimssion of coded information through a transmission medium such as a communication network but also to recording to a recording medium. Also, the present invention can be effectively applied to the case where high-speed processing is required, as in the change of the compression rate of each unit time in accordance with changes of the transmission line capacity with the lapse of time.

According to the present invention, an input signal is converted to information of a plurality of frequency bands, and the information of each band is coded. A plurality of partial code strings made up of auxiliary data and main data are generated with respect to codes equivalent to information of each predetermined unit time. The partial code strings are rearranged in the order from a partial code string of the highest importance from a leading part of a code string block of each predetermined unit time, thus generating a code string. Therefore, a code string having a compression rate changed at a high speed with a small quantity of operation can be generated.

Also, according to the present invention, to decode codes generated by coding a signal of each predetermined unit time on the side of a coding device, a code string having partial code strings, including auxiliary data for decoding generated for each of a plurality of frequency bands from the codes on the side of the coding device and main data expressing components of the signal, arrayed in a predetermined order from a leading part of a code string block of each predetermined unit time is decomposed into the codes, and an output signal is generated on the basis of the codes obtained by decomposition. Therefore, a code string having a compression rate changed at a high speed with a small quantity of operation can be decoded.

Also, according to the present invention, a coding program is recorded which includes a transform step of converting an input signal to a plurality of units of information of each frequency band, a coding step of coding the information of each band from the transform step, and a code string generation step of generating a plurality of partial code strings made up of auxiliary data and main data with respect to codes equivalent to information of each predetermined unit time from the coding step and rearranging the partial code strings in the order from a partial code string of the highest importance from a leading part of a code string block of each predetermined unit time, thus generating a code string. Therefore, a computer or the like is enabled to generate a code string having a compression rate changed at a high speed with a small quantity of operation.

Also, according to the present invention, a decoding program for decoding codes generated by coding a signal of each predetermined unit time on the side of a coding device is recorded. The decoding program includes a decomposition step of decomposing into the codes a code string having partial code strings, including auxiliary data for decoding generated for each of a plurality of frequency bands from the codes on the side of the coding device and main data expressing components of the signal, arrayed in a predetermined order from a leading part of a code string block of each predetermined unit time, and a signal generation step of generating an output signal on the basis of the codes obtained by decomposition of the decomposition step. Therefore, a computer or the like is enabled to decode a code string having a compression rate changed at a high speed with a small quantity of operation.

Moreover, according to the present invention, a code string is recorded which is generated by converting an input signal to a plurality of units of information of each of a plurality of frequency bands, coding the information of each band, forming a plurality of partial code strings made up of auxiliary data and main data with respect to codes equivalent to information of each predetermined unit time, and rearranging the plurality of partial code strings in the order from a partial code string of the highest importance from a leading part of a code string block of each predetermined unit time. Therefore, a decoding device is enabled to decode a code string having a compression rate changed at a high speed with a small quantity of operation, easily at any time.

What is claimed is:

1. A coding device comprising:

transform means for converting an input signal to information of a plurality of frequency bands;

coding means for coding the information of each band from the transform means;

code string generation means for generating a code string by generating a plurality of partial code strings having auxiliary data and main data generated with respect to codes equivalent to information of each predetermined unit time from the coding means, and rearranging the partial code strings in an order from a partial code string of a highest importance from a leading part of a code string block of each predetermined unit time; and compression rate change means for changing a compression rate of the code string generated by the code string generation means, wherein the compression rate change means generates a code string having a different compression rate than the code string generated by the code string generation means by cutting out a portion of the leading part of the code string block for each predetermined unit time.

2. The coding device as claimed in claim 1, wherein the transform means carries out spectrum transform of the input signal for each predetermined unit time so as to form a unit for each frequency band.

3. The coding device as claimed in claim 2, wherein the coding means codes information of each unit from the transform means to a normalization coefficient, a number of quantization steps, and a spectrum coefficient.

4. The coding device as claimed in claim 3, wherein the code string generation means generates the plurality of partial code strings from the auxiliary data including both the normalization coefficient and the number of quantization steps and the main data including the spectrum coefficient, and rearranges the partial code strings in the order from the partial code string of the highest importance from the leading part of the code string block of each predetermined unit time, thus generating the code string.

5. A coding device comprising:

transform means for converting an input signal to information of a plurality of frequency bands;

coding means for coding the information of each band from the transform means;

code string generation means for generating a code string by generating a plurality of partial code strings having auxiliary data and main data generated with respect to codes equivalent to information of each predetermined unit time from the coding means, and rearranging the partial code strings in an order from a partial code string of a highest importance from a leading part of a code string block of each predetermined unit time; and compression rate change means for changing a compression rate of the code string generated by the code string generation means, wherein the code string generation means generates the code string from codes equivalent to minimum necessary information for decoding the code string block equivalent to the information of each predetermined unit time, and arranges the code string at the leading part of the code string block of each predetermined unit time, and wherein the compression rate change means generates a code string having a different compression rate than the code string generated by the code string generation means rearranging a plurality of coding units from the leading part of the code string block for each predetermined unit time continuously to a code string equivalent to the minimum necessary information.

6. The coding device as claimed in claim 5, wherein the compression rate change means generates the code string having the different compression rate by cutting out a portion of the leading part of the code string block of each predetermined unit time continuously to the code string equivalent to the minimum necessary information.

7. The coding device as claimed in claim 1, wherein the coding means and the code string generation means recognize in advance a value of a length of the portion of the code string to be cut out by the compression rate change means, and generate the code string so as to be equivalent to a boundary of the partial code string having that value.

8. The coding device as claimed in claim 6, wherein the coding means and the code string generation means recognize in advance a value of a length of the portion of the code string to be cut out by the compression rate change means, and generate the code string so as to be equivalent to a boundary of the partial code string having that value.

9. The coding device as claimed in claim 1, wherein the code string generation means rearranges the plurality of partial code strings in the order from a partial code string of a lowest frequency component.

10. The coding device as claimed in claim 1, wherein the code string generation means rearranges the plurality of partial code strings in the order from a partial code string of a highest energy.

11. The coding device as claimed in claim 1, wherein the code string generation means rearranges the plurality of partial code strings in the order from a partial code string of a highest quantization precision.

12. A coding method comprising the steps of:

converting an input signal to information of a plurality of frequency bands;

coding the information of each band;

generating a code string by generating a plurality of partial code strings having auxiliary data and main data generated with respect to codes equivalent to information of each predetermined unit time, and rearranging the partial code strings in an order from a partial code string of a highest importance from a leading part of a code string block of each predetermined unit time, and changing a compression rate of the generated code string, wherein the compression rate of the code string is changed by cutting out a portion of the leading part of the code string block for each predetermined unit time.

13. The coding method as claimed in claim 12, wherein the input signal is processed into a unit for each frequency band after spectrum transform for each predetermined unit time, then information of each unit is converted to a normalization coefficient, a number of quantization steps, and a spectrum coefficient, the plurality of partial code strings are generated from the auxiliary data including both the normalization coefficient and the number of quantization steps and the main data including the spectrum coefficient, and the partial code strings are arranged in the order from a partial code string of the highest importance from the leading part of the code string block of each predetermined unit time.

14. A coding method comprising the steps of:

converting an input signal to information of a plurality of frequency bands;

coding the information of each band;

generating a code string by generating a plurality of partial code strings having auxiliary data and main data generated with respect to codes equivalent to information of each predetermined unit time, and rearranging the partial code strings in an order from a partial code string of a highest importance from a leading part of a code string block of each predetermined unit time, and changing a compression rate of the generated code string, wherein the code string is generated from codes equivalent to minimum necessary information for decoding the code string block equivalent to the information of each predetermined unit time, and is arranged at the leading part of the code string block of each predetermined unit time, and wherein the step of changing the compression rate of the generated code string comprises generating a code string having a different compression rate than the code string generated by rearranging a plurality of coding units from the leading part of the code string block for each predetermined unit time continuously to a code string equivalent to the minimum necessary information.

15. The coding method as claimed in claim 14, wherein generating a code string having a different compression rate comprises cutting out a portion of the leading part of the code string block of each predetermined unit time continuously to the code string equivalent to the minimum necessary information.

16. The coding method as claimed in claim 12, wherein a value of a length of the portion of the code string to be cut out is recognized in advance, and the code string is generated so as to be equivalent to a boundary of the partial code string having that value.

17. The coding method as claimed in claim 15, wherein a value of a length of the portion of the code string to be cut is recognized in advance, and the code string is generated so as to be equivalent to a boundary of the partial code string having that value.

18. A decoding device for decoding codes generated by coding a signal of each predetermined unit time on a side of a coding device, the decoding device comprising:

decomposition means for decomposing into the codes a code string having partial code strings arrayed in a predetermined order from a leading part of a code string block of each predetermined unit time, the partial code strings including main data expressing components of the signal and auxiliary data for decoding generated at each of a plurality of frequency bands from the codes on the side of the coding device;

signal generation means for generating an output signal on a basis of the codes obtained by decomposition by the decomposition means; and compression rate change means for changing a compression rate of the code string sent from the side of the coding device, wherein the compression rate change means changes the compression rate of the code string by cutting to a different length the leading part of the code string block of the code string sent from the side of the coding device for each predetermined unit time.

19. The decoding device as claimed in claim 18, wherein the signal generation means has decoding means for decoding the main data of the codes obtained by decomposition by the decomposition means, using the auxiliary data, and transform means for converting a decoded signal from the decoding means to an audio signal.

20. A decoding method for decoding codes generated by coding a signal of each predetermined unit time on a side of a coding device, the decoding method comprising:

decomposing into the codes a code string having partial code strings arrayed in a predetermined order from a leading part of a code string block of each predetermined unit time, the partial code strings including main data expressing components of the signal and auxiliary data for decoding generated at each of a plurality of frequency bands from the codes on the side of the coding device;

generating an output signal on a basis of the codes obtained by decomposition; and changing a compression rate of the code string sent from the side of the coding device, wherein the compression rate of the code string is changed by cutting to a different length the leading part of the code string block of the code string sent from the side of the coding device for each predetermined unit time.

21. The decoding method as claimed in claim 20, wherein the main data of the codes obtained by decomposition is decoded by using the auxiliary data, and the decoded signal is converted to an audio signal as an output signal.

22. A program recording medium having a coding program recorded therein, the coding program comprising the steps of:

converting an input signal to a plurality of units of information of each of a plurality of frequency bands;

coding the information of each band from the transform step;

generating a code string by generating a plurality of partial code strings having auxiliary data and main data with respect to codes equivalent to information of each predetermined unit time from the coding step and rearranging the partial code strings in an order from a partial code string of a highest importance from a leading part of a code string block of each predetermined unit time; and changing a compression rate of the generated code string, wherein the compression rate of the code string is changed by cutting out a portion of the leading part of the code string block for each predetermined unit time.

23. A program recording medium having a decoding program recorded therein, the program for decoding codes generated by coding a signal of each predetermined unit time on a side of a coding device, the program comprising the steps of:

decomposing into the codes a code string having partial code strings arrayed in a predetermined order from a leading part of a code string block of each predetermined unit time, the partial code strings including main data expressing components of the signals and auxiliary data for decoding generated at each of a plurality of frequency bands from the codes on the side of the coding device;

generating an output signal on a basis of the codes obtained by decomposition of the decomposition step; and changing a compression rate of the code string sent from the side of the coding device, wherein the compression rate of the code string is changed by cutting to a different length the leading part of the code string block of the code string sent from the side of the coding device for each predetermined unit time.

24. The coding device as claimed in claim 5, wherein the transform means carries out spectrum transform of the input signal for each predetermined unit time so as to form a unit for each frequency band.

25. The coding device as claimed in claim 24, wherein the coding means codes information of each unit from the transform means to a normalization coefficient, a number of quantization steps, and a spectrum coefficient.

26. The coding device as claimed in claim 5, wherein the code string generation means rearranges the plurality of partial code strings in the order from a partial code string of a lowest frequency component.

27. The coding device as claimed in claim 5, wherein the code string generation means rearranges the plurality of partial code strings in the order from a partial code string of a highest energy.

28. The coding device as claimed in claim 5, wherein the code string generation means rearranges the plurality of partial code strings in the order from a partial code string of a highest quantization precision.

29. The coding method as claimed in claim 14, wherein the input signal is processed into a unit for each frequency band after spectrum transform for each predetermined unit time, then information of each unit is converted to a normalization coefficient, a number of quantization steps, and a spectrum coefficient, the plurality of partial code strings are generated from the auxiliary data including both the normalization coefficient and the number of quantization steps and the main data including the spectrum coefficient, and the partial code strings are arranged in the order from a partial code string of the highest importance from the leading part of the code string block of each predetermined unit time.

30. A program recording medium having a coding program recorded therein, the coding program comprising the steps of:

converting an input signal to a plurality of units of information of each of a plurality of frequency bands;

coding the information of each band from the transform step;

generating a code string by generating a plurality of partial code strings having auxiliary data and main data with respect to codes equivalent to information of each predetermined unit time from the coding step and rearranging the partial code strings in an order from a partial code string of a highest importance from a leading part of a code string block of each predetermined unit time; and changing a compression rate of the generated code string, wherein the code string is generated from codes equivalent to minimum necessary information for decoding the code string block equivalent to the information of each predetermined unit time, and is arranged at the leading part of the code string block of each predetermined unit time, and wherein the step of changing the compression rate of the generated code string comprises generating a code string having a different compression rate than the code string generated by rearranging a plurality of coding units from the leading part of the code string block for each predetermined unit time continuously to a code string equivalent to the minimum necessary information.

* * * * *